US006772727B2

(12) United States Patent
Kim

(10) Patent No.: US 6,772,727 B2
(45) Date of Patent: Aug. 10, 2004

(54) APPARATUS FOR DEACTIVATING ONE OR MORE CYLINDERS OF AN INTERNAL COMBUSTION ENGINE

(75) Inventor: Myoung-Jin Kim, Suwon (KR)

(73) Assignee: Hyundai Motor Company, Seoul (KR)

( * ) Notice: Subject to any disclaimer, the term of this patent is extended or adjusted under 35 U.S.C. 154(b) by 33 days.

(21) Appl. No.: 10/171,670

(22) Filed: Jun. 14, 2002

(65) Prior Publication Data

US 2002/0189577 A1 Dec. 19, 2002

(30) Foreign Application Priority Data

Jun. 15, 2001 (KR) ..... 2001-0033825

(51) Int. Cl.[7] ..... F02B 77/00
(52) U.S. Cl. ..... 123/198 F
(58) Field of Search ..... 123/198 F, 481, 123/184.21, 336, 337

(56) References Cited

U.S. PATENT DOCUMENTS 3,765,394 A * 10/1973 Francis ..... 123/198 F
4,401,068 A * 8/1983 Bristol ..... 123/198 F

FOREIGN PATENT DOCUMENTS

JP 01-217395 8/1989
JP 10-330248 11/1998

* cited by examiner

*Primary Examiner*—Tony M. Argenbright
*Assistant Examiner*—Hyder Ali
(74) *Attorney, Agent, or Firm*—Morgan Lewis & Bockius LLP

(57) ABSTRACT

The present invention provides an apparatus for deactivating one or more cylinders of an internal combustion engine. The apparatus comprises: a surge tank being provided with a plurality of chambers, said chambers temporarily storing air being provided from a throttle body; an air distributor for selectively providing air to said chambers of said surge tank; and an intake manifold connected to the chambers of the surge tank.

9 Claims, 2 Drawing Sheets

APPARATUS FOR DEACTIVATING ONE OR MORE CYLINDERS OF AN INTERNAL COMBUSTION ENGINE

FIELD OF THE INVENTION

The present invention relates to an internal combustion engine, and more particularly, to an apparatus for selectively deactivating one or more cylinders of an internal combustion engine.

BACKGROUND OF THE INVENTION

Generally, in an internal combustion engine, fuel is burned in a combustion chamber, and the internal combustion engine is operated using power that is generated when the burned fuel expands. An internal combustion engine is provided with a plurality of cylinders. Deactivation of one or more cylinders during low engine load and allowing the remaining cylinders to carry the load increases fuel economy. Such multi-cylinder engines capable of cylinder deactivation have been produced. Typically, in the case of an in-line 4 cylinder engine, two cylinders are deactivated; in the case of a V-6, three cylinders (one bank) are deactivated. Here, "deactivating a cylinder" means inhibiting any of intake of an air/fuel mixture, combustion, and exhaust of combustion gas, while allowing reciprocating motion of a piston.

Typically, the deactivation of cylinders is performed by an apparatus for disabling the camshaft such that the intake valve is maintained in a closed state. However, cylinder deactivation apparatus according to the prior art require an apparatus for disabling the camshaft, and therefore, manufacturing costs increase.

SUMMARY OF THE INVENTION

In a preferred embodiment of the present invention, an apparatus for deactivating one or more cylinders of an internal combustion engine comprises a surge tank, an air distributor, and an intake manifold. The surge tank inclues a plurality of chambers that temporarily store air provided from a throttle body. The air distributor selectively provides air to the chambers of the surge tank. The intake manifold is connected to the chambers of the surge tank. Preferably, the surge tank is divided into two chambers by a dividing wall, and the air distributor is disposed between the throttle body and the surge tank.

In a further preferred embodiment, the air distributor comprises a first plate, a second plate, a rotator, and a plurality of air distributing tubes, wherein the first plate is provided with a plurality of openings equidistantly located on a circular line formed at a constant radius from a center thereof. The second plate is rotatably disposed proximate to said first plate, the second plate being provided with a plurality of openings located at positions corresponding to the openings of the first plate and one additional opening located on the circular line midway between any two of the equidistantly located openings. The rotator rotates the second plate, and the plurality of air distributing tubes provide communication between the openings of the first plate and the chambers of the surge tank.

More preferably, the rotator comprises a rotating rod, a connecting rod, and an actuator. One end portion of the rotating rod is connected to the second plate; the connecting rod is hingedly connected to the other end portion of the rotating rod; and the actuator moves the connecting rod such that the rotating rod rotates. It is preferable that the actuator is a solenoid.

It is further preferable that the first plate is provided with two openings, and that the second plate is provided with two openings corresponding to the openings of the first plate and one additional opening located midway between the two openings on the circular line formed at a constant radius from the center thereof.

In a further alternative embodiment of the invention, a housing communicates with an air intake. An air distributing member is disposed in the housing. At least first and second distributing tubes communicate with the housing and with a surge tank. The surge tank is divided into first and second chambers, each chamber communicating with one of the tubes. Each chamber communicates via an intake manifold with a selected number of cylinders less than all cylinders of the engine. Preferably, the air distributing member comprises first and second plates. The first plate defines at least first and second openings, each opening being aligned with one of the distributing tubes. The second plate is disposed between the first plate and the distributing tubes and is rotatable between a first position permitting air flow to all distributing tubes and a second position blocking air flow to at least one distributing tube.

In a further preferred embodiment, the second plate defines a first set of two openings alignable with the first and second distributing tubes and a second set of one opening rotatably displaced from the first set and alignable with one distributing tube. The apparatus may also comprise a rotating rod secured to the second plate, a connecting rod cooperating with the rotating rod, a connection bar pivotably connected to the connecting rod, and a solenoid acting on the connection bar. Actuation of the solenoid rotates the second plate to a predetermined orientation.

BRIEF DESCRIPTION OF THE DRAWINGS

The accompanying drawings, which are incorporated in and constitute a part of the specification, illustrate an embodiment of the invention, and, together with the description, serve to explain the principles of the invention, wherein.

DETAILED DESCRIPTION OF THE PREFERRED EMBODIMENTS

Hereinafter, a preferred embodiment of the present invention will be described in detail with reference to the accompanying drawings.

Figure 1:
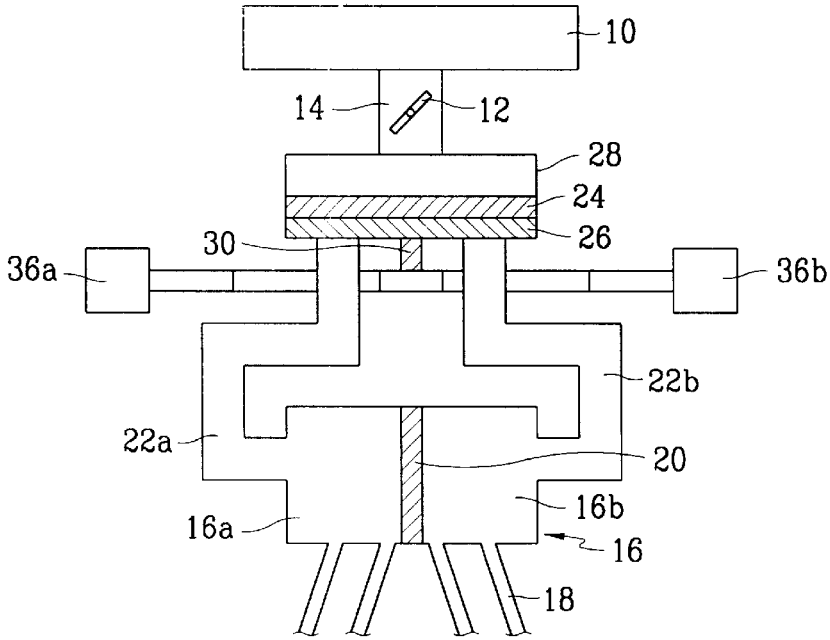
FIG. 1 is a schematic view of the cylinder deactivation apparatus according to a preferred embodiment of the present invention.

As shown in FIG. 1, an air supply system of an internal combustion engine comprises an air cleaner 10, a throttle body 14 defining a throttle bore where a throttle valve 12 for regulating an amount of intake air is mounted, a surge tank 16 for temporarily storing air provided from the throttle body 14, and an intake manifold 18 for providing air of the surge tank 16 into combustion chambers (not shown).

An apparatus for deactivating one or more cylinders according to the invention therefore preferably comprises the surge tank 16, which is divided into two chambers 16*a* and 16*b* by a dividing wall 20. Air is respectively provided into the chambers 16*a* and 16*b* from the throttle body 14 through air distributing tubes 22*a* and 22*b*. Also, the intake manifold 18 is connected to the surge tank 16 so that air is supplied to the combustion chambers.

The cylinder deactivation apparatus according to the present invention further includes an air distributing member for distributing air between chambers 16*a* and 16*b* of the surge tank 16. The air distributing member includes a first circular plate 24 and a second circular plate 26. The first circular plate 24 is fixedly mounted to a housing 28, and the second circular plate 26 is rotatable with respect to the first circular plate 24 and is disposed to closely contact the first circular plate 24. Two circular holes 24*a* and 24*b* are formed on the first circular plate 24, as shown in FIGS. 3 and 4.

Figure 3:
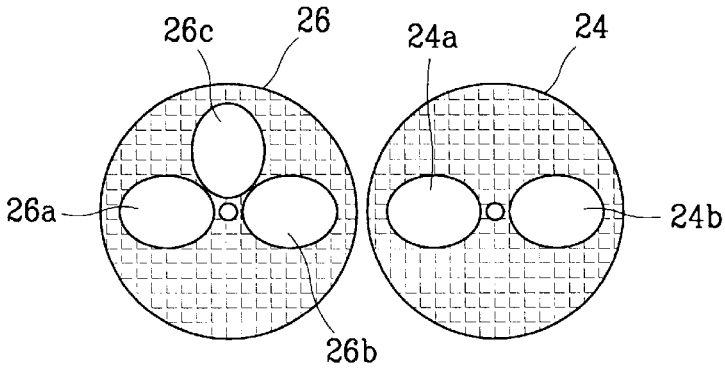
FIG. 3 shows the state of first and second circular plates during full engine load.
Figure 4:
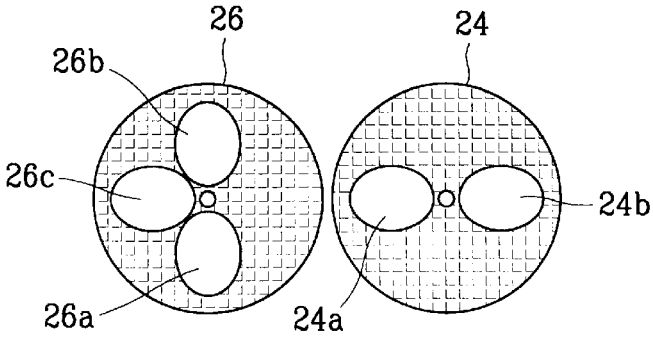
FIG. 4 shows the state of first and second circular plates during low engine load.

The second circular plate 26, as shown in FIGS. 3 and 4, is provided with three circular holes 26*a*, 26*b*, and 26*c*. Positions of the holes 26*a* and 26*b* correspond to positions of the holes 24*a* and 24*b* of the first circular plate 24, and the hole 26*c* is located on a line perpendicular to a line connecting centers of the holes 24*a* and 24*b* when the second circular plate 26 is in a position for operating all cylinders, at the same distance from the center of the plate as the others.

If the second circular plate 24 rotates with respect to the first circular plate, the holes 24*a* and 24*b* are selectively opened or closed. The air distributing tubes 22*a* and 22*b* are connected to a lower portion of the housing 28 at positions corresponding to the positions of the holes 24*a* and 24*b* of the first circular plate 24.

The second circular plate 26 is closely contacted to the first circular plate 24 such that air does not leak therebetween when air is supplied to the chambers 16*a* and 16*b* of the surge tank 16 through the air distributing tubes 22*a* and 22*b*. The first circular plate 24 is mounted to the housing 28 such that air passing through the throttle body 14 flows into the holes 24*a* and 24*b*.

Figure 2:
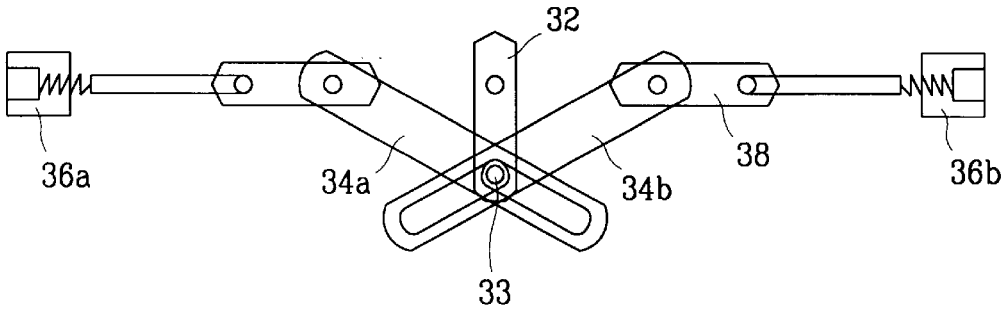
FIG. 2 is a plane view of a rotator of the cylinder deactivation apparatus of FIG. 1.

As shown in FIG. 2, a rotator for rotating the second circular plate 26 comprises a rotating rod 32 with one end fixedly connected to a central axis of the second circular plate 26 through a post 30, a pair of connecting rods 34*a* and 34*b* that are hingedly connected to a hinge post 33 on the other end of the rotating rod 32. Solenoids 36*a* and 36*b* are hingedly connected to connecting rods 34*a* and 34*b*. Because the rotating rod 32 is fixed to the central axis of the second circular plate 26 through the post 30, the second circular plate 26 rotates with the rotating rod 32.

The connecting rods 34*a* and 34*b* are connected to the rotating rod 32 such that if one of the connecting rods 34*a* or 34*b* moves more than a certain amount, the rotating rod 32 rotates. That is, the connecting rods 34*a* and 34*b* are provided with slots, and if one of the connecting rods 34*a* or 34*b* moves an amount greater than the length of the slot with respect to the hinge post 33, the rotating rod 32 rotates.

The solenoids 36*a* and 36*b* are hingedly connected to the connecting rods 34*a* and 34*b*. When the solenoids are located far from the connecting rods, connecting bars 38 can be disposed between the connecting rods and the solenoids. The solenoids 36*a* and 36*b* are actuated to move the connecting rods 34*a* and 34*b* according to signals indicating engine load.

Operation of the cylinder deactivation apparatus according to the present invention will be explained hereinafter.

During full engine-load, the second circular plate 26 is controlled to rotate such that the holes 26*a* and 26*b* of the second circular plate 26 are overlapped with the holes 24*a* and 24*b* of the first circular plate 24, as shown in FIG. 3. Thus, air is supplied to both the chambers 16*a* and 16*b* of the surge tank 16 through the holes 24*a*, 24*b*, 26*a*, and 26*b*, and the air distributing tubes 22*a* and 22*b*. The air supplied to the chambers 16*a* and 16*b* is supplied to all combustion chambers through the intake manifold 18. All cylinders are then activated.

During low engine load, current is applied to only one of the solenoids 36*a* and 36*b*. If current is supplied to solenoid 36*b* and not to solenoid 36*a*, the connecting rod 34*b* is pulled by the solenoid action, and it slides along its slot on the hinge post 33 of the rotating rod 32. Once the end of the slot of the connecting rod 34*b* reaches the hinge post 33 of the rotating rod 32, continued pulling of the solenoid causes the rotating rod 32 to rotate. Therefore, the second circular plate 26 that is fixed to the rotating rod 32 through the post 30 rotates to a position as shown in FIG. 4.

As the connecting rod 34*b* causes the rotating rod 32 to rotate, the connecting rod 34*a* pivots at its hinge point with the solenoid 36*a* as the hinge post 33 moves along the slot of the connecting rod 34*a*.

When the second circular plate 26 is rotated to a point as shown in FIG. 4, air is supplied to the chamber 16*a* of the surge tank 16 through the air distributing tube 22*a* and the circular holes 24*a* and 26*c*. The air distributing tube 22*b* is closed by the second circular plate 26. Therefore, cylinders connected to the chamber 16*a* of the surge tank 16 are provided with air, and cylinders connected to the chamber 16*b* of the surge tank 16 are not provided with air and are therefore deactivated.

If a current is applied only to solenoid 36*a*, the second circular plate 26 rotates in a direction opposite to the direction resulting in the alignment of FIG. 4. In this case, air is supplied to the chamber 16*b* through the air distributing tube 22*b* and the circular holes 24*b* and 26*c*. The air distributing tube 22*a* is closed by the second circular plate 26. Therefore, cylinders connected to the chamber 16*b* of the surge tank 16 are provided with air, and cylinders connected to the chamber 16*a* of the surge tank 16 are not provided with air and are therefore deactivated.

It is preferable that fuel is not injected into the cylinders to which air is not supplied.

As stated above, the cylinder deactivation apparatus according to the present invention can deactivate one or more of cylinders without an apparatus for disabling a camshaft. Therefore, the manufacturing costs decrease and the manufacturing process can be simplified.

Further, because opening/closing valve timing control, which has a serious affect on efficiency of an internal combustion engine, is not needed, the internal combustion engine can be optimally controlled while deactivating cylinders.

What is claimed is:

1. An apparatus for deactivating one or more cylinders of an internal combustion engine, said apparatus comprising:

a surge tank provided with a plurality of chambers, said chambers temporarily storing air being provided from a throttle body;

an air distributor for selectively providing air to said chambers of said surge tank; and an intake manifold connected to the chambers of the surge tank, wherein said air distributor comprises:

a first plate provided with a plurality of openings equidistantly located on a circular line formed at a constant radius from a center thereof;

a second plate rotatably disposed proximate to said first plate, said second plate provided with a plurality of openings located at positions corresponding to the openings of said first plate and one additional opening located on the circular line midway between any two of the equidistantly located openings;

a rotator for rotating the second plate; and a plurality of air distributing tubes communicating the openings of the first plate with the chambers of the surge tank.

2. The apparatus of claim 1, wherein said surge tank is divided into two chambers by a dividing wall.

3. The apparatus of claim 1, wherein said air distributor is disposed between said throttle body and said surge tank.

4. The apparatus of claim 1, wherein said rotator comprises:

a rotating rod, one end portion of which is connected to the second plate;

a connecting rod hingedly connected to the other end portion of the rotating rod; and an actuator for moving the connecting rod such that the rotating rod rotates.

5. The apparatus of claim 4, wherein said actuator is a solenoid.

6. The apparatus of claim 1, wherein the first plate is provided with two openings, and the second plate is provided with two openings corresponding to the openings of the first plate and one additional opening located midway between the two openings on a circular line formed at a constant radius from a center thereof.

7. An apparatus for deactivating one or more cylinders of an internal combustion engine, comprising:

a housing communicating with an air intake;

an air distributing member disposed in said housing;

at least first and second distributing tubes communicating with said housing through said air distributing member;

a surge tank communicating with said distributing tubes, wherein said surge tank is divided into first and second chambers, each chamber communicating with one of said tubes, and each chamber communicating via an intake manifold with a selected number of cylinders less than all cylinders, wherein said air distributing member comprises:

a first plate defining at least first and second openings, each said opening being aligned with one of said distributing tubes; and a second plate disposed between the first plate and said distributing tubes, wherein said second plate is rotatable between a first position permitting air flow to all distributing tubes and a second position blocking air flow to at least one distributing tube.

8. The apparatus of claim 7, wherein said second plate defines a first set of two openings alignable with said first and second distributing tubes and a second set of one opening rotatably displaced from said first set and alignable with one said distributing tube.

9. The apparatus of claim 7, further comprising:

a rotating rod secured to the second plate;

a connecting rod cooperating with the rotating rod;

a connection bar pivotably connected to the connecting rod; and a solenoid acting on the connection bar;

whereby actuation of the solenoid rotates the second plate to a predetermined orientation.

* * * * *